US009382922B2

(12) United States Patent
Dunning

(10) Patent No.: US 9,382,922 B2
(45) Date of Patent: Jul. 5, 2016

(54) EDUCTOR PUMP AND REPLACEABLE WEAR INSERTS AND NOZZLES FOR USE THEREWITH

(71) Applicant: ALSTOM Technology Ltd., Baden (CH)

(72) Inventor: Harvey Kent Dunning, Cromwell, CT (US)

(73) Assignee: ALSTOM TECHNOLOGY LTD, Baden (CH)

( * ) Notice: Subject to any disclaimer, the term of this patent is extended or adjusted under 35 U.S.C. 154(b) by 360 days.

(21) Appl. No.: 13/739,784

(22) Filed: Jan. 11, 2013

(65) Prior Publication Data

US 2014/0196795 A1 Jul. 17, 2014

(51) Int. Cl.

| | |
|---|---|
| ***F04F 5/44*** | (2006.01) |
| ***F04F 5/00*** | (2006.01) |
| *B01F 5/04* | (2006.01) |
| *F04F 5/24* | (2006.01) |

(52) U.S. Cl.

CPC ... *F04F 5/44* (2013.01); *F04F 5/00* (2013.01); *B01F 5/04* (2013.01); *B01F 2005/0431* (2013.01); *B01F 2005/0433* (2013.01); *B01F 2005/0438* (2013.01); *B01F 2005/0443* (2013.01); *F04F 5/24* (2013.01); *Y10T 137/0441* (2015.04); *Y10T 137/87652* (2015.04)

(58) Field of Classification Search

CPC ..... B01F 5/04; B01F 2005/0431; B01F 2005/0433; B01F 2005/0438; B01F 2005/0443; F04F 5/00; F04F 5/24; F04F 5/54; F04F 5/44; Y10T 137/87652; Y10T 137/0441

USPC ..... 417/170, 171, 193, 195, 198, 163, 167, 417/53; 366/163.2; 137/15.08; 29/888.02, 29/21

See application file for complete search history.

(56) References Cited

U.S. PATENT DOCUMENTS

| | | | | |
|---|---|---|---|---|
| 2,046,887 | A * | 7/1936 | Walch | 417/168 |
| 3,807,987 | A * | 4/1974 | Peacock | 423/1 |
| 3,825,286 | A * | 7/1974 | Henry, III | 285/93 |
| 4,041,981 | A * | 8/1977 | Davis | C02F 1/763 261/64.1 |
| 4,210,166 | A * | 7/1980 | Munie | 137/271 |
| 4,396,355 | A * | 8/1983 | Wilmot | B65G 53/30 417/160 |

(Continued)

FOREIGN PATENT DOCUMENTS

JP 10253410 A * 9/1998

OTHER PUBLICATIONS

Pump Scout, https://web.archive.org/web/20120606131131/http://www.pumpscout.com/articles-scout-guide/pump-types-guide-aid100.html, published Jun. 6, 2012.*

*Primary Examiner* — Devon Kramer
*Assistant Examiner* — Nathan Zollinger
(74) *Attorney, Agent, or Firm* — ALSTOM Power Inc.

(57) ABSTRACT

An eductor for conveying materials includes a body defining a first end and a second end and having a first inlet proximate the first end and a body outlet proximate the second end, the body defining a second inlet positioned between the first inlet and the body outlet, and the body defining an interior area. The eductor includes one or more inserts disposed within the body. The insert or inserts are manufactured from an abrasion resistant material.

21 Claims, 4 Drawing Sheets

(56) References Cited

U.S. PATENT DOCUMENTS 4,562,612 A * 1/1986 Williams et al. ..... 15/409
5,007,803 A * 4/1991 DiVito et al. ..... 417/137
6,354,371 B1 * 3/2002 O'Blanc ..... 166/69
6,523,991 B1 * 2/2003 Maklad ..... B01F 5/0403 137/889
6,669,790 B1 12/2003 Gundlach et al.
6,800,152 B2 10/2004 Gundlach et al.
8,845,178 B2 * 9/2014 Hanada ..... B01F 3/0865 137/888
9,242,260 B2 * 1/2016 Stevenson ..... B05B 7/30
2007/0152355 A1 * 7/2007 Hartley ..... B01F 5/0413 261/76

* cited by examiner

EDUCTOR PUMP AND REPLACEABLE WEAR INSERTS AND NOZZLES FOR USE THEREWITH

TECHNICAL FIELD

The present disclosure is generally directed to an eductor pump and replaceable wear inserts and nozzles for use in educator pumps, and in particular to thin wall, abrasion resistant and high hardness wear inserts.

BACKGROUND

Eductor pumps, also referred to as jet pumps, typically include a body that has a motive fluid inlet section with a motive fluid nozzle disposed therein. The eductor body also defines a mixing chamber positioned downstream of the motive fluid nozzle. The mixing chamber also includes a solids inlet port for supplying solids such as bottom ash, fly ash, pyrites or other solids into the mixing chamber. The solids inlet port is typically positioned on an upper portion of the mixing chamber so that the solids can be gravity fed into the mixing chamber from a hopper. The eductor pump also includes a venturi or diffuser that consists of an inlet nozzle, a throat section and a discharge nozzle. The educator and the components thereof have predetermined optimal contours, dimensions and shapes to attain design flow and velocity requirements of the fluids and solids flowing therethrough.

A fluid flowing through the motive fluid nozzle is discharged into the mixing chamber in a high velocity jet stream and creates a suction pressure in portions of the mixing chamber around the jet stream. However, fluids in other portions of the eductor, for example in the motive fluid nozzle and in portions of the diffuser can be 150 psi or more. As a result, the solids that are fed into the mixing chamber by gravity feed and assisted by the suction pressure are entrained in the jet stream and are subsequently ejected into the diffuser. A mixture of the solids and the motive fluid are discharged from the discharge nozzle of the diffuser to a suitable holding area.

During operation the fluids and solids flow through the eductor under pressure. The bottom ash, fly ash, pyrites and other solids conveyed in the eductor are generally abrasive and can cause sliding and impact erosion of internal surfaces of the eductor. The eductors and components thereof are typically manufactured as one integral unit, for example a single casting, from a metal alloy that is abrasive resistant and capable of withstanding the operating pressure. However, over time, the eductor and components thereof wear causing the predetermined contours, dimensions and shapes change and degradation. As a result, the design flow and velocity requirements of the fluids and solids flowing through the educator can no longer be attained. To remedy the wear problems, the entire single unit educator must typically be replaced at a significant cost.

SUMMARY

According to aspects illustrated herein a there is provided an eductor for conveying materials (e.g. solids, fluids, liquids, and particulate matter) which includes a body defining a first end and a second end and having a first inlet proximate the first end and a body outlet proximate the second end. The body defines a second inlet positioned between the first inlet and the body outlet. The body also defines an interior area. The eductor includes one or more inserts manufactured from an abrasion resistant material.

In one embodiment the abrasion resistant material is a wear resistant, heat treated white iron material.

According to further aspects illustrated herein, the insert includes one or more of a mixing chamber insert, a motive fluid nozzle, a feeder conduit insert, a venturi outlet insert and/or a venturi inlet insert.

According to further aspects illustrated herein, there is provided a method for refurbishing a worn eductor. A mixing chamber insert, a motive fluid nozzle, a feeder conduit insert, a venturi outlet insert and/or a venturi inlet insert are removed from the eductor. A removable and abrasion resistant mixing chamber insert, motive fluid nozzle, feeder conduit insert, venturi outlet insert and/or venturi inlet insert is (are) installed in the eductor.

According to further aspects illustrated herein, there is provided an eductor for conveying materials. The educator includes a body defining a pressure boundary. The body includes a first end and a second end and having a first inlet proximate the first end and a body outlet proximate the second end. The body defines a second inlet positioned between the first inlet and the body outlet. The body further defines a first interior area which extends between first inlet, the second inlet and the body outlet. The educator includes a mixing chamber insert positioned in the body, proximate the first inlet and extending downstream thereof. The mixing chamber insert defines a second interior area that is in communication with the first inlet, the second inlet and the body outlet. The mixing chamber insert is manufactured from an abrasion resistant material. The educator includes a motive fluid nozzle positioned in the first inlet and extended at least partially into the mixing chamber insert. The motive fluid nozzle is manufactured from an abrasion resistant material. The educator includes a feeder conduit insert positioned in the second inlet. The feeder conduit insert defines a third interior area that is in communication with the second interior area. The feeder conduit insert is manufactured from an abrasion resistant material. The educator includes a venturi outlet insert positioned in the body outlet. The venturi outlet insert is manufactured from an abrasion resistant material. The educator includes a venturi inlet insert positioned in the first interior area and having one end positioned proximate the mixing chamber insert. The venturi inlet insert is manufactured from an abrasion resistant material.

The above described and other features are exemplified by the following figures and in the detailed description

BRIEF DESCRIPTION OF THE DRAWINGS

Referring now to the figures, which are exemplary embodiments, and wherein the like elements are numbered alike.

DETAILED DESCRIPTION

Figure 1:
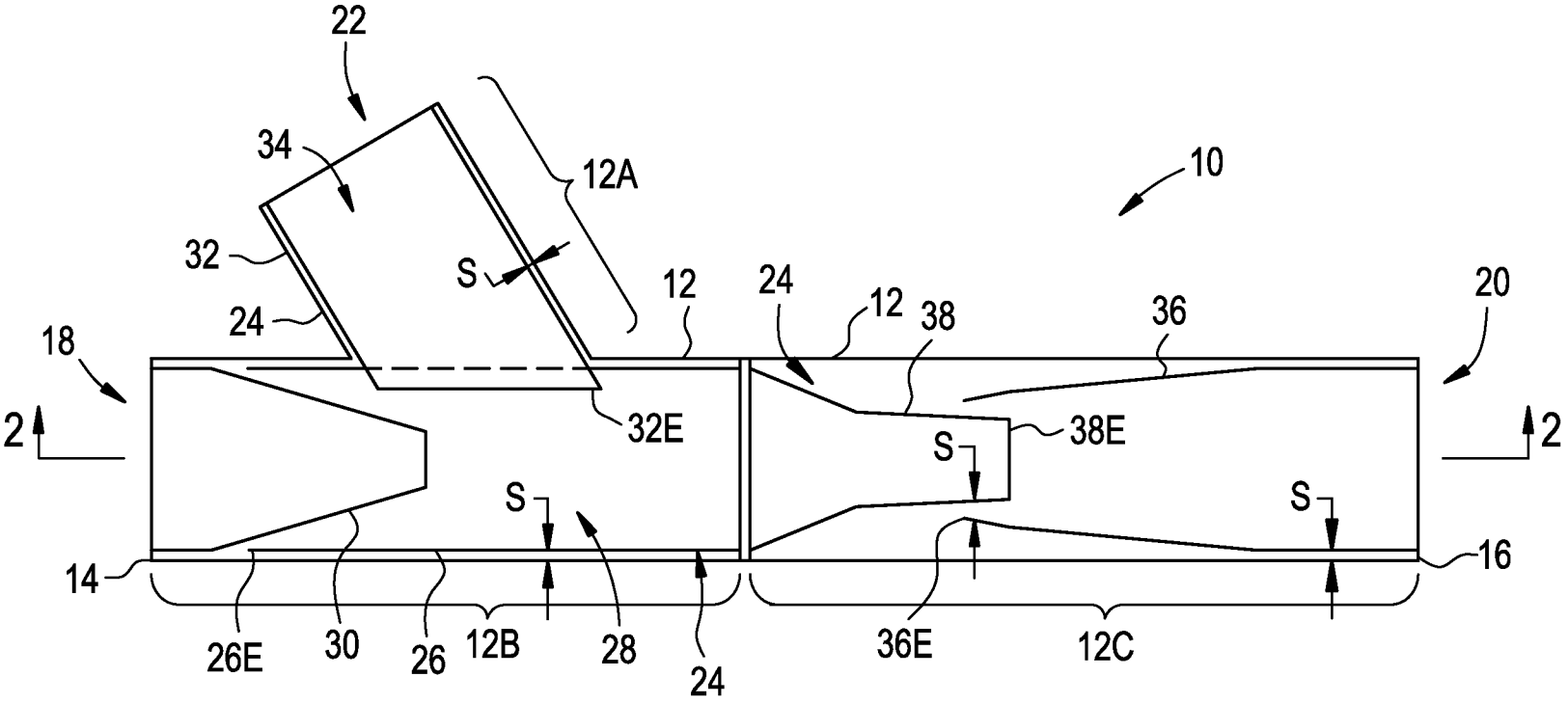
FIG. 1 is a schematic line drawing of an eductor as disclosed herein.
Figure 2:
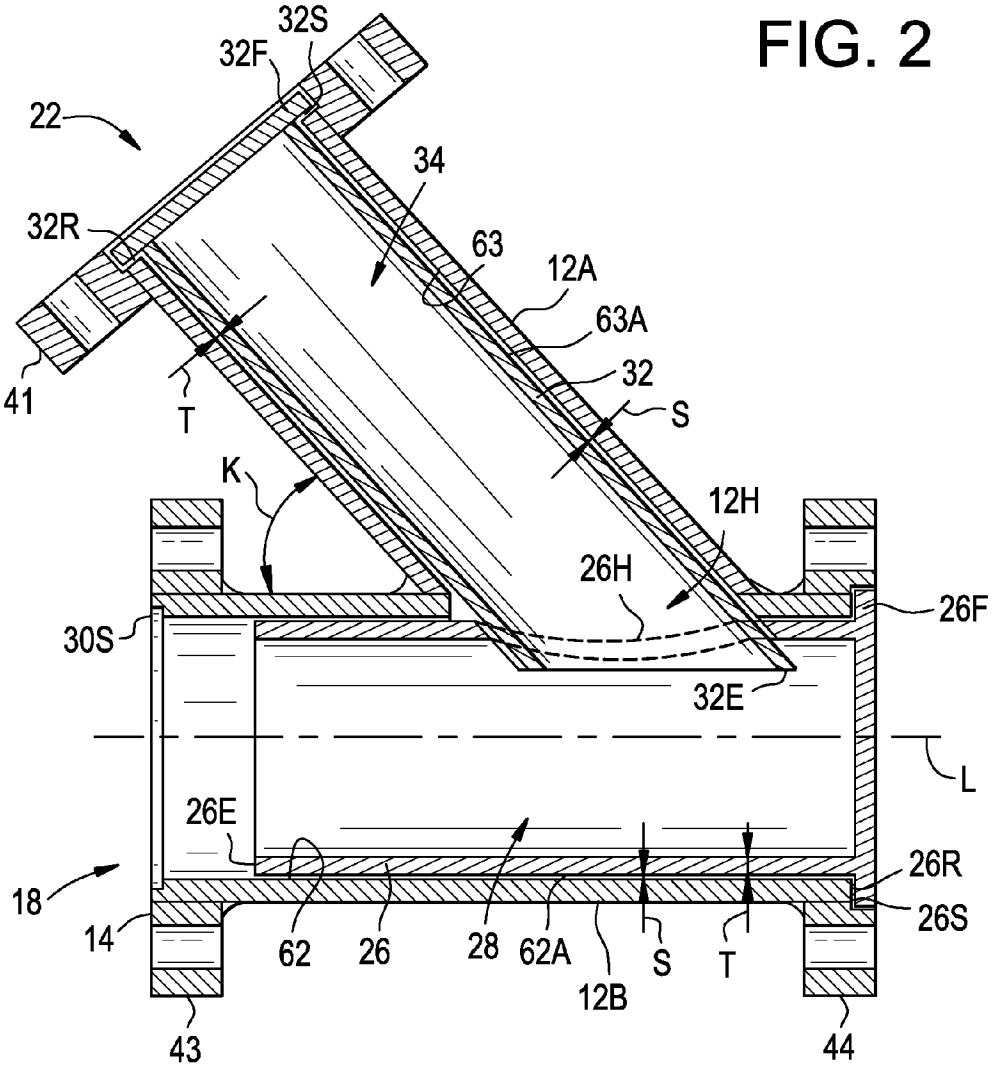
FIG. 2 is a side cross sectional view of a portion of the eductor of FIG. 1.
Figure 3:
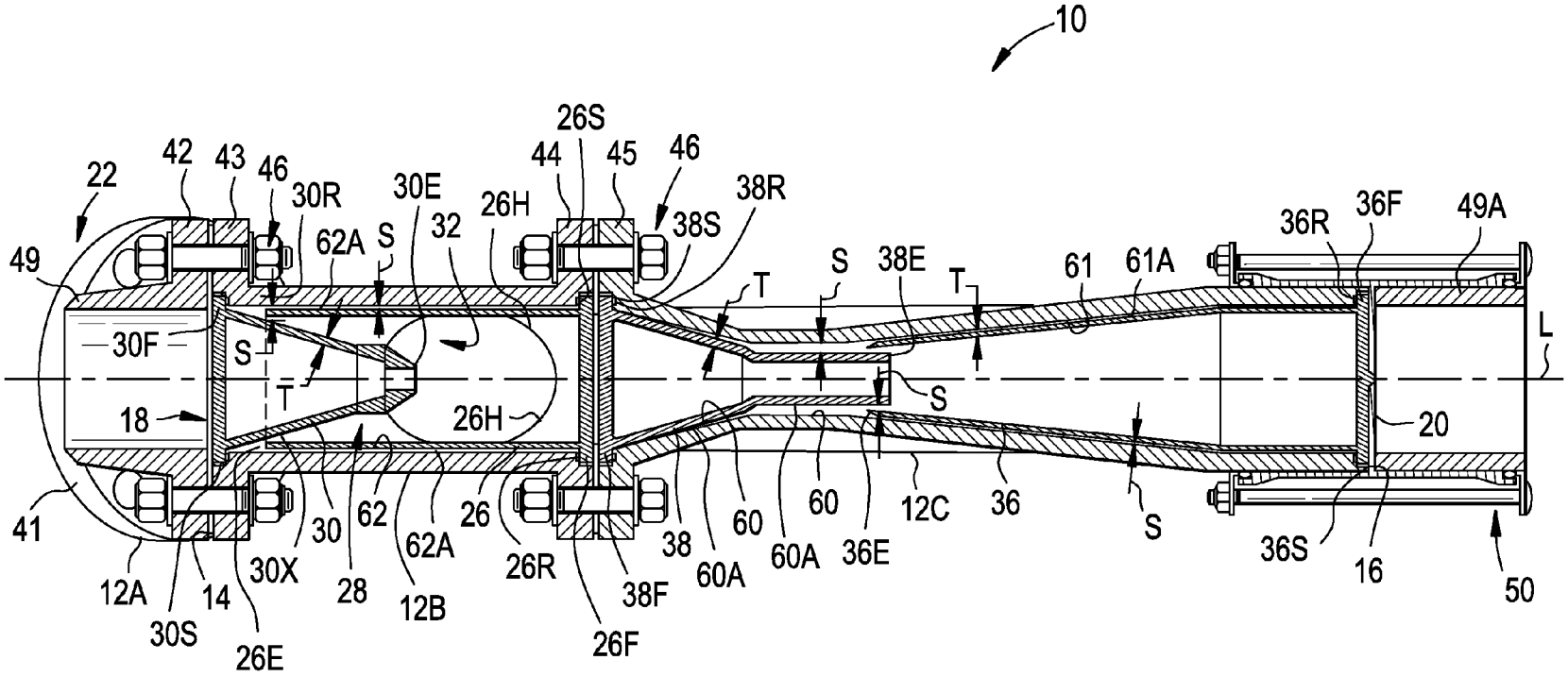
FIG. 3 is a cross sectional via of the eductor of FIG. 1 taken across line 2-2.

Referring to FIGS. 1-3, there is illustrated an eductor generally designated by the numeral 10. The eductor 10 is configured to convey materials such as materials, such as solids, liquids, fluids, particulate matter and combination thereof, as described below. The eductor 10 defines a body 12 comprising a pressure boundary. The body 12 defines a first end 14 and a second end 16. The eductor 10 has a first inlet 18 located proximate the first end 14 and a body outlet 20 located proximate the second end 16. The body 12 defines a second inlet 22 positioned between the first inlet 18 and the body outlet 20. The body 12 defines an interior area 24 (e.g., a through bore or inner cavity) which extends between first inlet 18, the second inlet 22 and the body outlet 20. The interior area 24 of the body 12 has several segments (e.g., internal chambers) configured to receive inserts (e.g., slid into and out of the body) and removably secure the inserts to portions of the body 12, as described herein.

The eductor 10 includes a mixing chamber insert 26 that is removably positioned in interior area 24 of the body 12, proximate the first inlet 18 and extends downstream thereof. For example, the mixing chamber insert 26 is slid into and out of the interior area 24 of the body 12 of the educator 10. The mixing chamber insert 26 defines an interior area 28 that is in communication with the first inlet 18, the second inlet 22 and the body outlet 20. The eductor 10 includes a motive fluid nozzle 30 removably positioned in the first inlet 18 and extends at least partially into the mixing chamber insert 26. The eductor 10 includes a feeder conduit insert 32 removably positioned in the second inlet 22. The feeder conduit insert 32 defines an interior area 34 that is in communication with the interior area 28 of the mixing chamber insert 26. The eductor 10 includes a venturi outlet insert 36 positioned in the body outlet 20 and a venturi inlet insert 38 positioned in the interior area 24 of the body 12. The venturi inlet insert 38 has one end positioned proximate the mixing chamber insert 26. The mixing chamber insert 26, the motive fluid nozzle 30, the feeder conduit insert 32, the venturi outlet insert 36 and/or the venturi inlet insert 38 are removable from the eductor and are manufactured from an abrasion resistant material. In one embodiment, the mixing chamber insert 26, the motive fluid nozzle 30, the feeder conduit insert 32, the venturi outlet insert 36 and/or the venturi inlet insert 38 are removable from the eductor and are manufactured from a thin cast or wrought material as described further herein, and are referred to generally as inserts. These inserts provide a lining to protect the body from wear.

In one embodiment, the abrasion resistant material is a wear resistant, heat treated white iron casting. As illustrated in FIGS. 2 and 3, in one embodiment, the mixing chamber insert 26, the motive fluid nozzle 30, the feeder conduit insert 32, the venturi outlet insert 36 and/or the venturi inlet insert 38 have wall thicknesses T of about 0.25 to 0.75 inches. In one embodiment, the abrasion resistant material has a hardness of greater than or equal to 650 Brinnell scale (BHN). For example, the abrasion resistant material has a hardness of about 650 to about 750 BHN. Through significant experimentation and experience the inventor found that prior art wear resistant materials could not be cast as thin as 0.25 to 0.75 inches and have the abrasion resistant material having a hardness of greater than or equal to 650 Brinnell scale (BHN). However, the inventor surprisingly found that heat treated white iron material that could be cast as thin as 0.25 to 0.75 inches, have the abrasion resistant material has a hardness of greater than or equal to 650 Brinnell scale (BHN) and therefore be used in the manufacture of abrasion resistant replaceable wear inserts and nozzles for eductor pumps.

As best shown in FIG. 1 the body 12 includes three segments, for example, a feeder body segment 12A, a main body segment 12B and a venturi receiving segment 12C. Referring to FIG. 3, the main body segment 12B and the venturi receiving segment 12C are aligned coaxially along a longitudinal axis L are removably coupled to one another with a coupling system, for example flanges 44 and 45 and suitable fasteners 46. The main body section 12B has another flange 43 positioned on the first end 14 of the main body 12B for coupling to another flange 42 positioned on an upstream conduit 49 configured to deliver a motive fluid to the motive fluid nozzle 30. As best shown in FIG. 2, the feeder body segment 12A is secured to and projects from the main body segment 12B at an area between the flange 43 and the flange 44.

As shown in FIG. 2, the feeder body segment 12A extends from the main body section 12B at an angle K of about 30 to 45 degrees. While the angle K is described as being about 30 to 45 degrees the present disclosure is not limited in this regard as the feeder body segment 12A can extend from the main body segment 12B at any angle including but not limited to 45 to 90 degrees.

Referring to FIG. 3, the flange 43 of the main body segment 12B includes an annular seat 30S formed therein. The motive fluid nozzle 30 defines an annular lip 30F that extends radially outward from one end of the motive fluid nozzle 30. The lip 30F is positioned in the annular seat 30S with an o-ring 30R or a gasket disposed therebetween. In one embodiment, the o-ring 30R is seated in an annular groove formed in the annular seat 30S. The lip 30F and the o-ring 30R are compressed in the annular seat 30S between the flanges 42 and 43 by tightening the fasteners 46 associated therewith, thereby retaining the lip 30F in the annular seat 30S. The o-ring 30R helps attenuate vibration of the motive fluid nozzle 30. The motive fluid nozzle 30 defines a free end 30E that is spaced apart from the mixing chamber insert 26 and is axially moveable to accommodate axial thermal expansion and contraction of the motive fluid nozzle 30 in response to changes in temperature. An exterior surface 30X of the motive fluid nozzle is spaced apart from a free end 26E of the mixing chamber insert 26 by a minimum distance S to allow for radial thermal expansion and contraction of the motive fluid nozzle 30 and the mixing chamber insert 26.

Referring to FIG. 3, the flange 44 of the main body segment 12B includes an annular seat 26S formed therein. The mixing chamber insert 26 defines an annular lip 26F that extends radially outward from one end of the mixing chamber insert 26. The lip 26F is positioned in the annular seat 26S with an o-ring 26R or a gasket disposed therebetween. In one embodiment, the o-ring 26R is seated in an annular groove formed in the annular seat 26S. The lip 26F and the o-ring 26R are compressed in the annular seat 26S between the flanges 44 and 46 by tightening the fasteners 46 associated therewith, thereby retaining the lip 26F in the annular seat 26S. The o-ring 26R helps attenuate vibration of the mixing chamber insert 26. The mixing chamber insert 26 defines a free end 26E that is spaced apart from the exterior surface 30X of the motive fluid nozzle 30 and is axially moveable to accommodate axial thermal expansion and contraction of the mixing chamber insert 26 in response to changes in temperature. As illustrated in FIGS. 2 and 3 the mixing chamber insert 26 defines an exterior surface 62A that is spaced apart from (e.g., by a distance S) to allow for radial thermal expansion and contraction of the mixing chamber insert 32. The exterior surface 62A of the mixing chamber insert 32 is complementary in shape to an interior surface 62 defined by the main body segment 12B.

Referring to FIG. 3, the flange 45 of the venturi receiving segment 12C includes an annular seat 38S formed therein. The venturi inlet 38 defines an annular lip 38F that extends radially outward from one end of the venturi inlet 38. The lip 38F is positioned in the annular seat 38S with an o-ring 38R or a gasket disposed therebetween. In one embodiment, the o-ring 38R is seated in an annular groove formed in the annular seat 38S. The lip 38F and the o-ring 38R are compressed in the annular seat 38S between the flanges 44 and 45 by tightening the fasteners 46 associated therewith, thereby retaining the lip 38F in the annular seat 38S. The o-ring 38R helps attenuate vibration of the venturi inlet 38. The venturi inlet 38 defines a free end 38E that is spaced apart from the venturi outlet 36 and is axially moveable to accommodate axial thermal expansion and contraction of the venturi inlet 38 in response to changes in temperature. The free end 38E of the venturi inlet 38 extends partially into the venturi outlet 36 and is radially spaced apart therefrom by a distance S to allow for radial thermal expansion and contraction of the venturi inlet 38 and the venturi outlet 36. As shown in FIG. 3 the venturi inlet 38 defines an exterior surface 60A that is spaced apart from (e.g., by a distance S) to allow for radial thermal expansion and contraction of the venturi outlet 36. The exterior surface 60A of the venturi inlet 38 is complementary in shape to an interior surface 60 defined by the main body segment 12B.

Referring to FIG. 3, the end 16 of the venturi receiving segment 12C includes an annular seat 36S formed therein. The venturi outlet 36 defines an annular lip 36F that extends radially outward from one end of the venturi inlet 36. The lip 36F is positioned in the annular seat 36S with an o-ring 36R or a gasket disposed therebetween. In one embodiment, the o-ring 36R is seated in an annular groove formed in the annular seat 36S. The lip 36F and the o-ring 36R are compressed in the annular seat 36S between the flanges 44 and 45 by tightening the coupling 50 (e.g., a Dresser coupling), thereby retaining the lip 36F in the annular seat 36S. The o-ring 36R helps attenuate vibration of the venturi outlet 36. The venturi outlet 36 defines a free end 36E that is spaced apart from the venturi inlet 38 and is axially moveable to accommodate axial thermal expansion and contraction of the venturi outlet 36 in response to changes in temperature. The free end 38E of the venturi inlet 38 extends partially into the free end 36E of the venturi outlet 36. The coupling 49A removably secures the venturi receiving segment 12C to the conduit 49A. The venturi outlet 36 defines an exterior surface 61A that is spaced apart from (e.g., by a distance S) to allow for radial thermal expansion and contraction of the venturi outlet 36. The exterior surface 61A of the venturi outlet 36 is complementary in shape to an interior surface 61 defined by the main body segment 12B.

Referring to FIG. 2, the flange 41 of the feeder body segment 12A includes an annular seat 32S formed therein. The feeder conduit 32 defines an annular lip 32F that extends radially outward from one end of the feeder conduit 32. The lip 32F is positioned in the annular seat 32S with an o-ring 32R or a gasket disposed therebetween. In one embodiment, the o-ring 32R is seated in an annular groove formed in the annular seat 32S. The lip 32F and the o-ring 32R are compressed in the annular seat 32S between the flange 41 and another flange (not shown), thereby retaining the lip 32F in the annular seat 32S. The o-ring 32R helps attenuate vibration of the feeder conduit insert 32. The feeder conduit insert 32 defines a free end 32E that is spaced apart from the mixing chamber insert 26 and is axially moveable to accommodate thermal expansion and contraction of the feeder conduit insert 32 in response to changes in temperature. The free end 32E of the feeder conduit insert 32 extends through an opening 12H defined by the main body segment 12B and an opening 26H defined by the mixing chamber insert 26. In one embodiment, the free end 32E of the feeder conduit insert 32 extends into the interior area 28 of the mixing chamber insert 26. As shown in FIG. 2, the feeder conduit insert 32 defines an exterior surface 63A that is spaced apart from (e.g., by a distance S) to allow for radial thermal expansion and contraction of the feeder conduit insert 32. The exterior surface 63A of the feeder conduit insert 32 is complementary in shape to an interior surface 63 defined by the feeder body segment 12A.

Figure 4:
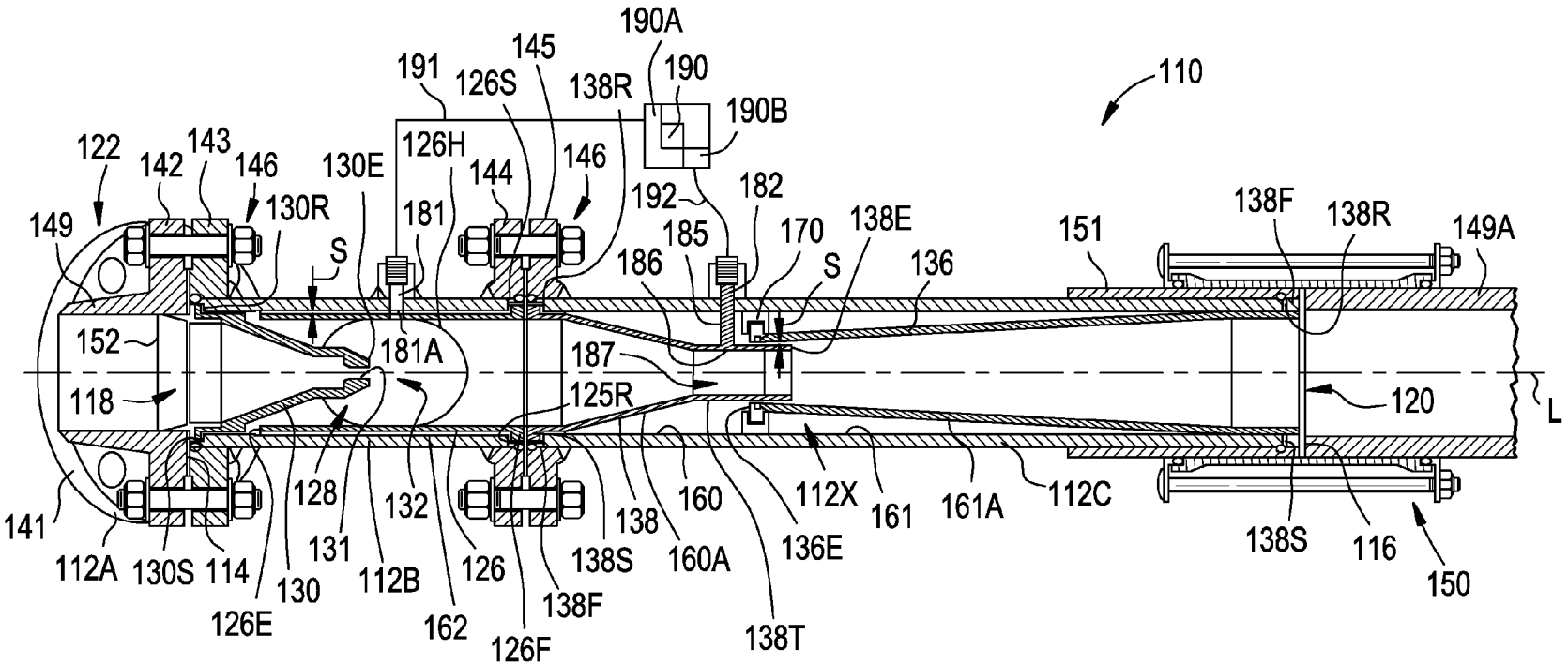
FIG. 4 is a cross sectional view of another embodiment of the eductor of FIG. 1 taken across line 2-2.

Referring to FIG. 4, the eductor 110 is similar to the eductor 10 of FIGS. 1-3, thus similar elements have been assigned like reference numbers preceded by the numeral 1. The feeder body segment 112A, the main body segment 112B and the venturi receiving segment 112C of the eductor 110 are fabricated from pipe sections and flanges. In one embodiment, the pipe sections are schedule 40 steel pipe.

As shown in FIG. 4, the venturi receiving segment 112C defines an interior surface 161 that is spaced apart from an exterior surface 161A of the venturi outlet 136 and an exterior surface 160A of the venturi inlet 138, thereby defining a cavity 112X therebetween. The free end 136E of the venturi outlet 136 is nested in an annular support 170 that centers and supports the venturi outlet 136 therein. The annular support 170 is in sliding engagement with the interior surface 161 of the venturi receiving segment 112C so that the free end 136E is moveable in an axial direction along the longitudinal axis L.

The mixing chamber insert 126 and the feeder conduit insert 132 (similar to the feeder conduit insert 34 of FIG. 1) fit in and slidingly engage the interior surfaces of the main body segment 112B and the feeder body segment 112A, respectively.

In one embodiment, the eductor 110 includes a sleeve 151 positioned around a portion of the venturi body segment 112C proximate the end 116 and inside the coupling 150 to match the outside diameter of the conduit 149A to which the venturi body segment 112C is removably secured.

Referring to FIG. 4, the main body segment 112B has a first bore 181 extending therethrough and the mixing chamber insert 126 has a second bore 181A extending therethrough and into the interior area 128 of the mixing chamber insert 126. The venturi inlet insert 138 defines a throat section 138T having an interior area 187. The throat section 138T has a third bore 186 extending therethrough. The main body section 112B has a fourth bore 182 extending therethrough. The third bore 186 and the fourth bore 182 are in communication with one another via a conduit 185 (e.g., a tube or pipe nipple). The third bore 186 and the fourth bore 182 are in communication with the interior areas 187 of the throat section 138T. The first bore 181 and the second bore 182 are in communication with pressure sensor 190A and 190B via lines 191 and 192, respectively. The pressure sensors 190A and 190B are in communication with a processor 190 for calculating differential pressure between the interior areas 128 of the mixing chamber insert 126 and the interior area 187 of the throat section 138T and for the calculation of velocities in and flow rates through the throat section 138T. While the eductor 110 is shown having the bores 181 and 182 and the pressure sensors 190A and 190B, the present disclosure is not limited in this regard as the eductor 10 shown in FIGS. 1-3 may also have similar bores, pressure sensors and a processor.

The mixing chamber insert 26, 126, the motive fluid nozzle 30, 130, the feeder conduit insert 32, 132, the venturi outlet insert 36, 136 and/or the venturi inlet insert 38, 138 can be used to refurbish worn eductors 10, 110 as shown in FIGS. 1-4. If the eductor is worn and needs replacement the mixing chamber insert 26, 126, the motive fluid nozzle 30, 130, the feeder conduit insert 32, 132, the venturi outlet insert 36, 136 and/or the venturi inlet insert 38, 138 can be removed from the eductor 10, 110. New ones of the mixing chamber insert 26, 126, the motive fluid nozzle 30, 130, the feeder conduit insert 32, 132, the venturi outlet insert 36, 136 and/or the venturi inlet insert 38, 138 can be removably installed in the feeder body segment 12A, 112A, the venturi receiving segment 12C, 112C and the main body segment 12A, 112A. As shown from FIGS. 1-4, the feeder conduit insert will protrude into the mixing chamber insert at the opening/inlet 26H, 126*d*. The replacement can be accomplished insitu, for example at the location where the eductor 10, 110 is installed, rather than having to install an entirely new eductor.

While the mixing chamber insert 26, 126, the motive fluid nozzle 30, 130, the feeder conduit insert 32, 132, the venturi outlet insert 36, 136 and/or the venturi inlet insert 38, 138 are shown and described as being removably installed in the feeder body segment 12A, 112A, the venturi receiving segment 12C, 112C and the main body segment 12A, 112A, the present disclosure is not limited in this regard as the mixing chamber insert 26, 126, the motive fluid nozzle 30, 130, the feeder conduit insert 32, 132, the venturi outlet insert 36, 136 and/or the venturi inlet insert 38, 138 can be fixedly installed in the feeder body segment 12A, 112A, the venturi receiving segment 12C, 112C and the main body segment 12A, 112A, for example by welding, brazing, and by use of an adhesive.

While the present invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An eductor for conveying materials, comprising:

a body including a pressure boundary, the body defining a first end and a second end and having a first inlet proximate the first end and a body outlet proximate the second end, the body defining a second inlet positioned between the first inlet and the body outlet, and the body defining a first interior area which extends between the first inlet, the second inlet and the body outlet, the body defining an interior surface; and a plurality of inserts disposed within the body, each insert having an exterior surface, said plurality of inserts being formed of an abrasion resistant material, wherein the plurality of inserts include:

a mixing chamber insert positioned in the first interior area proximate the first inlet and extending downstream thereof, the mixing chamber insert defining a second interior area that is in communication with the first inlet, the second inlet and the body outlet wherein the mixing chamber insert includes a first mixing chamber insert inlet arranged proximate the first end of the body, a mixing chamber insert outlet arranged proximate the second end of the body and a second mixing chamber insert inlet;

a motive fluid nozzle positioned in the first inlet;

a feeder conduit insert positioned in the second inlet, the feeder conduit insert defining a third interior area that is in communication with the second interior area, the feeder conduit insert protruding into the second mixing chamber insert inlet;

a venturi outlet insert positioned in the body outlet: and a venturi inlet insert positioned in the first interior area, wherein each exterior surface is complementary in shape to a corresponding portion of the interior surface, both surfaces spaced apart from each other by a distance to allow for radial thermal expansion and contraction of the mixing chamber insert, the feeder conduit insert, the venturi inlet insert and the venturi outlet insert.

2. The eductor of claim 1 wherein the motive fluid nozzle is positioned in the first inlet and extends at least partially into the mixing chamber insert;

wherein the venturi inlet insert has one end positioned proximate the mixing chamber insert.

3. The eductor of claim 1, wherein at least one insert of the plurality of inserts is removable from the eductor.

4. The eductor of claim 1, wherein the abrasion resistant material is a wear resistant, heat treated white iron.

5. The eductor of claim 1, wherein at least one of the mixing chamber insert, the motive fluid nozzle, the feeder conduit insert, the venturi outlet insert and the venturi inlet insert defines a mounting portion removably secured to the body and at least one free end that is movable relative to the mounting portion to accommodate thermal expansion and contraction in response to changes in temperature.

6. The eductor of claim 1, wherein the mixing chamber insert has a first bore extending therethrough and the venturi inlet insert has a second bore extending therethrough.

7. The eductor of claim 6, comprising:

a differential pressure sensor having one side in communication with the first bore and an opposing side in communication with the second bore for measuring differential pressure between the second interior area and a fourth interior area defined by the venturi inlet insert.

8. The eductor of claim 5, wherein the body comprises at least a first body portion separate from a second body portion.

9. The eductor of claim 8, wherein the first body portion and the second body portion are removably secured to one another.

10. The eductor of claim 8, wherein the mounting portion of the mixing chamber insert is removably secured to a portion of the first body portion proximate to the venturi inlet insert.

11. The eductor of claim 8, wherein the mounting portion of the venturi inlet insert is removably secured to a portion of the second body portion proximate to the mixing chamber insert.

12. The eductor of claim 8, wherein the mounting portion of the venturi outlet insert is removably secured to the second body portion proximate to the body outlet.

13. The eductor of claim 8, wherein the mounting portion of the motive fluid nozzle is removably secured to the first body portion proximate to the first inlet.

14. The eductor of claim 8, wherein the mounting portion of the feeder conduit insert is removably secured to the first body portion proximate to the second inlet.

15. The eductor of claim 1, wherein the feeder conduit insert extends partially into the second interior area of the mixing chamber insert.

16. The eductor of claim 1, wherein the body is manufactured from a cast material.

17. The eductor of claim 1, wherein the body comprises at least two pipe sections.

18. The eductor of claim 17, wherein at least one of the at least two pipe sections defines the interior surface that is spaced apart from exterior surfaces of the venturi outlet insert and the venturi inlet insert.

19. The eductor of claim 18, comprising:

an annular spacer having an exterior surface which engages the interior pipe surface, the annular spacer having an interior support surface which engages the exterior surface of the venturi outlet insert so that the venturi outlet insert and the venturi inlet insert are supported centrally in the at least one of the at least two pipe sections.

20. A method of refurbishing a worn eductor comprising:

removing a mixing chamber insert, a motive fluid nozzle, a feeder conduit insert, a venturi outlet insert and a venturi inlet insert from the eductor; and installing a removable abrasion resistant mixing chamber insert having a first mixing chamber insert inlet, a motive fluid nozzle, a feeder conduit insert, a venturi outlet insert and a venturi inlet insert into the eductor, wherein the feeding conduit insert is installed to protrude into a second mixing chamber insert inlet.

21. An eductor for conveying materials comprising:

a body including a pressure boundary, the body defining a first end and a second end and having a first inlet proximate the first end and a body outlet proximate the second end, the body defining a second inlet positioned between the first inlet and the body outlet, and the body defining a first interior area which extends between first inlet, the second inlet and the body outlet;

a mixing chamber insert positioned in the first interior area, proximate the first inlet and extending downstream thereof, the mixing chamber insert defining a second interior area that is in communication with the first inlet, the second inlet and the body outlet, the mixing chamber insert manufactured from an abrasion resistant material wherein the mixing chamber insert includes a first mixing chamber insert inlet arranged proximate the first end of the body, a mixing chamber insert outlet arranged proximate the second end of the body and a second mixing chamber insert inlet;

a motive fluid nozzle positioned in the first inlet and extended at least partially into the mixing chamber insert, the motive fluid nozzle manufactured from an abrasion resistant material;

a feeder conduit insert positioned in the second inlet, the feeder conduit insert defining a third interior area that is in communication with the second interior area, the feeder conduit insert manufactured from an abrasion resistant material, the feeder conduit insert protruding into the second mixing chamber insert inlet;

a venturi outlet insert positioned in the body outlet, the venturi outlet insert manufactured from an abrasion resistant material; and a venturi inlet insert positioned in the first interior area and having one end positioned proximate the mixing chamber insert, the venturi inlet insert manufactured from an abrasion resistant material.

* * * * *